US005714041A

United States Patent [19]

Ayers et al.

[11] Patent Number: 5,714,041

[45] Date of Patent: Feb. 3, 1998

[54] PAPERMAKING BELT HAVING SEMICONTINUOUS PATTERN AND PAPER MADE THEREON

[75] Inventors: Peter Graves Ayers, Middletown; Thomas Anthony Hensler, Cincinnati; Paul Dennis Trokhan, Hamilton, all of Ohio

[73] Assignee: The Procter & Gamble Company, Cincinnati, Ohio

[21] Appl. No.: 445,607

[22] Filed: May 22, 1995

Related U.S. Application Data

[62] Division of Ser. No. 384,199, Feb. 6, 1995, Pat. No. 5,628,876, which is a continuation of Ser. No. 936,954, Aug. 26, 1992, abandoned.

[51] Int. Cl.[6] ..... D21H 11/00

[52] U.S. Cl. ..... 162/111; 162/109

[58] Field of Search ..... 162/117, 113, 162/111, 109, 106, 334, 353; 428/153, 154

[56] References Cited

U.S. PATENT DOCUMENTS

| | | | |
|---|---|---|---|
| 3,301,746 | 1/1967 | Sanford et al. | 162/113 |
| 3,738,905 | 6/1973 | Thomas | 161/127 |
| 3,961,119 | 6/1976 | Thomas | 428/178 |
| 4,483,728 | 11/1984 | Bauernfeind | 156/209 |
| 4,514,345 | 4/1985 | Johnson et al. | 264/22 |
| 4,528,239 | 7/1985 | Trokhan | 428/247 |
| 4,919,756 | 4/1990 | Sawdai | 162/111 |
| 5,126,015 | 6/1992 | Pounder | 162/206 |

FOREIGN PATENT DOCUMENTS

| | | |
|---|---|---|
| 52-31446 | 8/1977 | Japan . |

*Primary Examiner*—Brenda A. Lamb

*Attorney, Agent, or Firm*—Larry L. Huston; E. Kelly Linman; Jacobus C. Rasser

[57] ABSTRACT

A secondary belt for papermaking. The belt has a framework of protuberances arranged in a semicontinuous pattern to provide a semicontinuous pattern of deflection conduits. The semicontinuous pattern is distinguished from the discrete and continuous patterns of the prior art. The protuberances may be generally parallel, or may provide individual cells within the deflection conduits between the protuberances. Also disclosed is the paper made on such a secondary belt.

5 Claims, 2 Drawing Sheets

PAPERMAKING BELT HAVING SEMICONTINUOUS PATTERN AND PAPER MADE THEREON

This is a divisional of application Ser. No. 08/384,199, filed on Feb. 6, 1995, now U.S. Pat. No. 5,628,876 which is a continuation of application Ser. No. 07/936,954, filed on Aug. 26, 1992 now abandoned.

FIELD OF THE INVENTION

The present invention relates to belts us for making cellulosic fibrous structures, such as paper. Particularly this invention relates to a belt used in a through-air drying process for making cellulosic fibrous structures, and more particularly to a belt having a particular pattern thereon which imparts properties to the paper in like pattern.

BACKGROUND OF THE INVENTION

Cellulosic fibrous structures, such as paper, are well known in the art. For example, cellulosic fibrous structures are a staple of every day life and are found in facial tissues, toilet tissue, and paper toweling.

One advancement in the art of cellulosic fibrous structures is cellulosic fibrous structures having multiple regions. A cellulosic fibrous structure is considered to have multiple regions when one region of the cellulosic fibrous structure differs in either basis weight, density, or both from another region of the cellulosic fibrous structure.

Multiple regions within a cellulosic fibrous structure can provide several advantages, such as economization of materials, increasing certain desirable properties and decreasing certain undesirable properties. However, the apparatus used to manufacture the multiple region cellulosic fibrous structure will greatly influence these properties.

Specifically a secondary belt, or comparable other apparatus, can affect the properties imparted to the cellulosic fibrous structure. As used herein, a "secondary apparatus" or a "secondary belt" refers to an apparatus or a belt, respectively, having an embryonic web contacting surface and which is used to carry or otherwise process an embryonic web of cellulosic fibers after initial formation in the wet end of the papermaking machinery. A secondary belt may include, without limitation, a belt used for molding an embryonic web of the cellulosic fibrous structure, a through-air drying belt, a belt used to transfer the embryonic web to another component in the papermaking machinery, or a backing wire used in the wet end of the papermaking machinery (such as a twin-wire former) for purposes other than initial formation. An apparatus or belt according to the present invention does not include embossing rolls, which deform dry fibers after fiber-to-fiber bonding has taken place. Of course, a cellulosic fibrous structure according to the present invention may be later embossed, or may remain unembossed.

As an example of how a secondary belt may input specific properties to a cellulosic fibrous structure, a wet molded and through-air dried cellulosic fibrous structure made on a secondary belt according to FIG. 4 of commonly assigned U.S. Pat. No. 4,514,345 issued Apr. 30, 1985 to Johnson, et al. may experience less curling at the edges than a cellulosic fibrous structure made on a secondary belt according to commonly assigned U.S. Pat. No. 4,528,239 issued Jul. 9, 1985 to Trokhan. Conversely, a cellulosic fibrous structure made on a secondary belt according to the aforementioned Trokhan patent may have a greater burst strength than a cellulosic fibrous structure made on a secondary belt according to FIG. 4 of the aforementioned, Johnson, et al. patent.

This difference in performance relative to properties such as absorbency and burst strength may be attributed to the pattern of the drying belt used in wet molding and the through-air drying process to make the respective cellulosic fibrous structures. A cellulosic fibrous structure made on a secondary belt according to FIG. 4 of the aforementioned Johnson, et al. patent will have discrete high density regions and essentially continuous low density regions. Conversely, a cellulosic fibrous structure made on a secondary belt according to the aforementioned Trokhan patent will have continuous high density regions and discrete low density regions. This difference in the pattern of the regions influences other properties of the respective cellulosic fibrous structures as well.

For example, a cellulosic fibrous structure made on a belt according to the aforementioned Trokhan patent may have a lower cross machine direction modulus of elasticity and may have greater cross machine direction extensibility than a cellulosic fibrous structure made on a belt according to the aforementioned Johnson, et al. patent. However, these properties are typically offset by less sheet shrinkage and edge curling in a cellulosic fibrous structure made on a belt according to the aforementioned Johnson, et al. patent.

The caliper of certain cellulosic fibrous structures is closely related to the crepe pattern caused by the impact angle of the doctor blade. The doctor blade is used to remove the cellulosic fibrous structure from the surface of a heated Yankee drying drum and to crepe the cellulosic fibrous structure by foreshortening it in the machine direction. However, maintaining constant material properties (such as machine direction extensibility), which properties are influenced by the doctor blade is difficult. This difficulty is encountered because the doctor blade wears over time. Such wear is rarely constant over time, due to the taper of the blade and the stiffness of the blade changing as a third order power when wear occurs. Furthermore, the wear and changes which occur on one papermaking machine utilizing a particular doctor blade are often totally different than the wear and changes which occur on another papermaking machine using an identical doctor blade.

As the doctor blade wears, and the impact angle between the doctor blade and the Yankee drying drum becomes smaller, the cellulosic fibrous structure typically becomes softer, but loses tensile strength. Also, as the impact angle becomes smaller due to wear, the cellulosic fibrous structure may have greater caliper. Conversely, as the impact angle between the doctor blade and the surface of the Yankee drying drum becomes greater, such as occurs when the bevel angle of the doctor blade is increased, the doctor blade will typically wear at a faster rate.

But, the situation is even more complicated than described above. Not all secondary belts produce cellulosic fibrous structures which respond alike to changes in the impact angle of the doctor blade. For example, a cellulosic fibrous structure through air dried on a belt made generally in accordance with the teachings of commonly assigned U.S. Pat. No. 3,301,746 issued Jan. 31, 1967 to Sanford, et al. shows an increase in caliper as the doctor blade impact angle is decreased. However, the caliper generated on a cellulosic fibrous structure made on a secondary belt according to the aforementioned Sanford, et al. patent is not as great as the caliper of a like cellulosic fibrous structure made on a secondary belt according to the aforementioned Trokhan patent. But a disadvantage to the aforementioned Trokhan patent is that a cellulosic fibrous structure made thereon does not show a correlation to the doctor blade impact angle, Thus, one skilled in the art is forced to select between greater caliper generation and control of the caliper (and other properties) by adjusting the doctor blade.

Furthermore, wear of the doctor blade and the associated changes in impact angle cause different effects in cellulosic fibrous structures, which effects depend upon the pattern of the protuberances in the secondary belt. A cellulosic fibrous structure made on a belt having discrete protuberances will increase in caliper as the doctor blade wears, if the blade impact angle is not adjusted to compensate. Conversely, a cellulosic fibrous structure made on a secondary belt having a continuous pattern of protuberances is less sensitive to such wear.

It is not surprising that considerable effort has been expended in the prior art to achieve constant material properties by adjusting the impact angle of the doctor blades. In one example, illustrated by commonly assigned U.S. Pat. No. 4,919,756 issued Apr. 24, 1990 to Sawdai, the doctor blade is continually adjusted to minimize the effects of doctor blade wear on the material properties of the cellulosic fibrous structure.

However, adjusting the doctor blade requires more equipment, associated maintenance, and set-up time for the papermaking machinery than machinery which simply tolerates changes in the doctor blade impact angle. While, of course, it is desirable to produce paper having certain consumer desired properties, the art clearly shows a need for greater flexibility in the manufacturing process, and particularly a way to achieve greater flexibility by not having to adjust the doctor blade impact angle using complex machinery.

More importantly, the prior art shows a need for a secondary belt which generates relatively high caliper yet responds to changes in the impact angle of the doctor blade with like changes in the caliper of the cellulosic fibrous structures dried thereon.

As noted above, one way to achieve greater caliper is by adjusting the doctor blade. Another way to increase the caliper of a cellulosic fibrous structure having multiple regions is to increase its basis weight. However, this arrangement also increases the basis weight of other regions in which it may not be desirable to do so, requires greater utilization of fibers, and increases the cost to the consumer.

With the present invention, a way has been found to decouple the relationship between the Z-direction extent of the protuberances and the caliper of the cellulosic fibrous structure. Furthermore, other properties of the cellulosic fibrous structure may benefit from having been made on a secondary belt according to the present invention.

For example, another problem frequently encountered with cellulosic fibrous structures which try to minimize fiber utilization and present less expense to the consumer is pinholing. Pinholing occurs when regions of the cellulosic fibrous structure are deflected into the deflection conduits of the secondary belts and break through, so that an opening is present and light passes through the opening. Pinholing and transmission of light therethrough present a cellulosic fibrous structure having a less durable and lower quality appearance to the consumer, and is accordingly undesirable to the consumer.

One cause of pinholing in a cellulosic fibrous structure made on a belt according to the aforementioned Trokhan patent is caliper generation resulting from protuberances which are too great in the Z-direction. By generating caliper in this manner, Z-direction deflection of the cellulosic fibrous structure occurs to an extent that pinholing results. Thus, one using the aforementioned Trokhan belt is forced to select between caliper generation and reduced pinholing.

Other problems found in cellulosic fibrous structures made on a belt according to the aforementioned Trokhan belt of the prior art are cross machine direction shrinkage and curling of the edges of the cellulosic fibrous structure. Such shrinkage and curling are caused by structural movement during machine direction tensioning, such as inevitably occurs during winding and converting. Shrinkage requires a wider cellulosic fibrous structure for manufacture. Edge curling may cause fold over, leading to breakage of the web during manufacture. Both cause greater expense in the manufacturing process.

Unfortunately, the amount of shrinkage is also closely related to the amount of cross machine direction extensibility the cellulosic fibrous structure will undergo before rupture. While relatively greater cross machine direction extensibility s highly desired, due to allowing the cellulosic fibrous structure to elastically deform without tearing or shredding in use, the penalty for such desired cross machine direction extensibility is paid for at the time of manufacture by encountering greater cross machine direction shrinkage and curling.

Accordingly, is an object of this invention to provide a secondary apparatus or belt which reduces occurrences of pinholing and shrinkage and curling of cellulosic fibrous structures during manufacture. It is an object of this invention to provide a secondary apparatus or belt which reduces occurrences of pinholing without requiring a corresponding reduction in the caliper of the cellulosic fibrous structure manufactured thereon. Furthermore, it is an object of the present invention to provide greater control over the caliper of the cellulosic fibrous structure with the impact angle of the doctor blade.

BRIEF SUMMARY OF THE INVENTION

The invention comprises an apparatus for manufacturing a cellulosic fibrous structure. The apparatus may comprise an endless belt having a reinforcing structure and a framework of protuberances joined thereto in a semicontinuous pattern. Between the protuberances are deflection conduits through which air may pass. The protuberances may be generally parallel, or may be arranged to provide individual cells within the deflection conduits. In another embodiment, the invention comprises the paper made on this secondary belt or apparatus.

BRIEF DESCRIPTION OF THE DRAWINGS

While the specification concludes with claims particularly pointing out and distinctly claiming the present invention, it is believed the same will be better understood by the following Specification taken in conjunction with the associated drawings in which like components are given the same reference numeral, and:

DETAILED DESCRIPTION OF THE INVENTION

Figure 1:
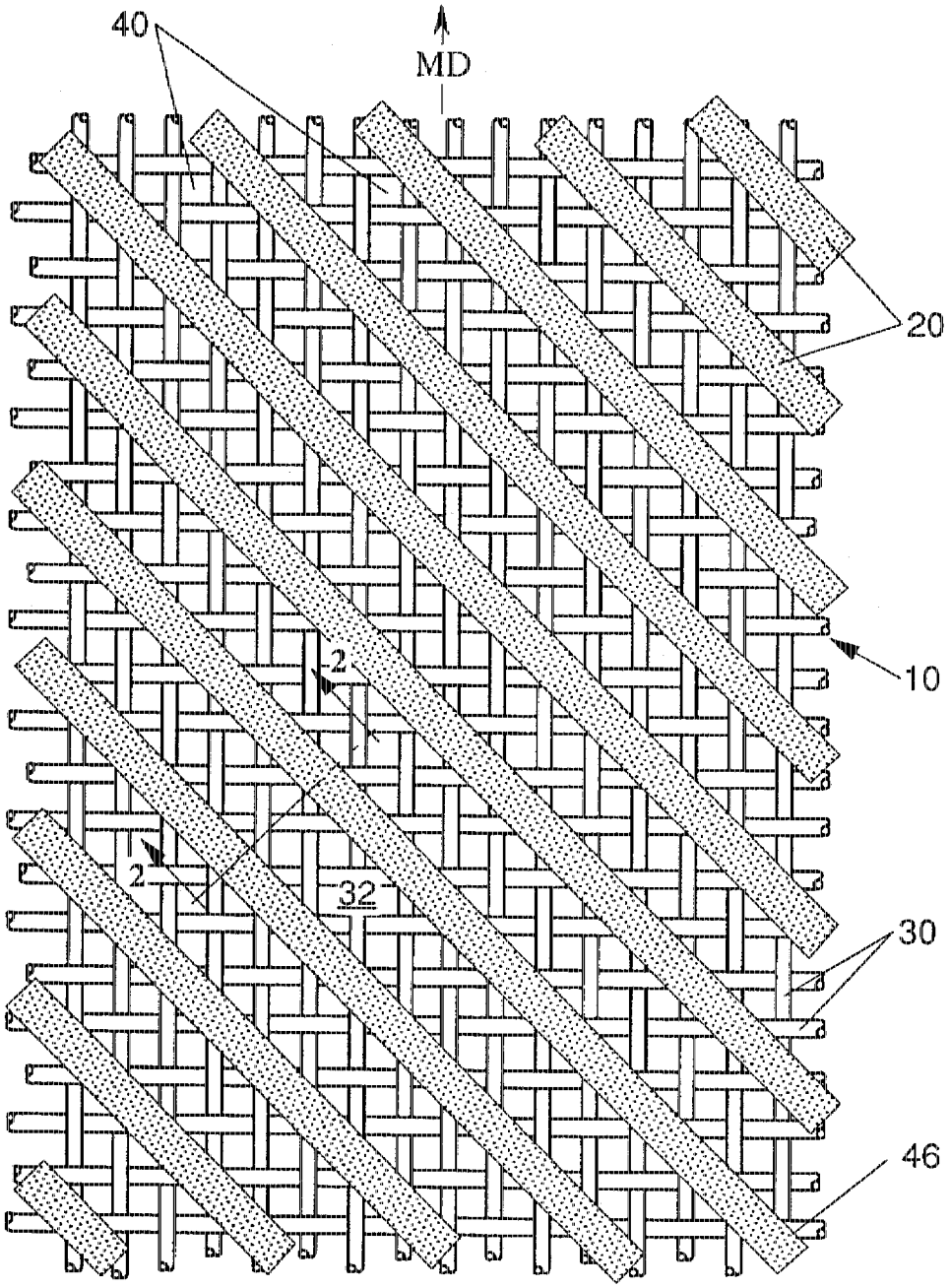
FIG. 1 is a top plan view of a secondary belt according to the present invention having parallel protuberances with parallel deflection conduits therebetween, the protuberances and deflection conduits being oriented at a diagonal relative to the machine direction and the cross machine direction.

The invention comprises an apparatus for manufacturing a cellulosic fibrous structure. The apparatus according to the present invention may be embodied in a variety of forms, such as stationary plates for making hand sheets, rotating drums for continuous processing and preferably endless belts 10 for ordinary papermaking machinery as illustrated in FIG. 1. Although these, and other, embodiments of the present invention are suitable, except as noted below, the preferred embodiment of the endless belt 10 is the embodiment discussed below with the understanding that other embodiments may be readily carried out by one skilled in the art.

The preferred endless belt 10 embodiment of an apparatus according to the present invention comprises two primary elements: a patterned framework of protuberances 20 and a reinforcing structure 30. The reinforcing structure 30 of the belt 10 has two opposed major surfaces. One major surface is the paper contacting side 32 and from which the protuberances 20 extend. The other major surface of the reinforcing structure 30 of the papermaking belt 10 is the backside 34, which contacts the machinery employed in typical papermaking operation. Machinery employed in typical papermaking operation include vacuum pickup shoes, rollers, etc., as are well known in the art and will not be further discussed herein.

Generally, for a belt 10 according to the present invention, the "machine direction" of the belt 10 is the direction within the plane of the belt 10 parallel to the principal direction of travel of the cellulosic fibrous structure during manufacture. The machine direction is designated by arrows "MD" in FIGS. 1 and 3. The cross machine direction is generally orthogonal the machine direction and also lies within the plane of the belt 10. The Z-direction is orthogonal both the machine direction and cross machine direction and generally normal to the plane of the belt 10 at any position in the papermaking process. The machine direction, cross machine direction, and Z-direction form a Cartesian coordinate system.

The belt 10 according to the present invention is essentially microscopically monoplanar. As used herein a component is "macroscopically monoplanar" if such component has two very large dimensions in comparison to a relatively small third dimension. The belt 10 is essentially macroscoptically monoplanar in recognition that deviations free absolute planarity are tolerable, but not preferred, so long as the deviations do not adversely affect the performance of the papermaking belt 10 in making cellulosic fibrous structures thereon.

In a rotating drum embodiment of the present invention (not shown), the reinforcing structure 30 may comprise a generally cylindrical shell having a plurality of holes therethrough. In a papermaking belt 10 embodiment, the reinforcing structure 30 comprises a series of filaments, preferably woven in a rectangular pattern to define interstices there-between. The interstices allow fluids, such as drying air, to pass through the belt 10 according to the present invention. The interstices form one of the groups of openings in the papermaking belt 10 according to the present invention, which openings are preferably smaller than those defined by the pattern of the framework.

If desired, the reinforcing structure 30 may have vertically stacked machine direction filaments to provide increased stability and load bearing capability. By vertically stacking the machine direction filaments of the reinforcing structure 30, the overall durability and performance of a belt 10 according to the present invention is enhanced.

The reinforcing structure 30 should not present significant obstruction to the flow of fluids, such as drying air therethrough and, therefore, should be highly permeable. The permeability of the reinforcing structure 30 may be measured by the airflow therethrough at a differential pressure of about 1.3 centimeters of water ("0.5" inches of water). A preferred reinforcing structure 30 having no framework of protuberances 20 attached thereto should have a permeability at this differential pressure of about 240 to 490 standard cubic meters per minute per square meter of belt 10 area (800 to 1,600 standard cubic feet per minute per square foot). Of course, it will be apparent that the permeability of the belt 10 will be reduced when the framework of protuberances 20 is attached to the reinforcing structure 30. A belt 10 having a framework of protuberances 20 preferably has an air permeability of about 90 to 180 standard cubic meters per minute per square meter (300 to 600 standard cubic feet per minute per square foot).

In an alternative embodiment, the reinforcing structure 30 of a belt 10 according to the present invention may have a textured backside 34. The textured backside 34 has a surface topography with asperities to prevent the buildup of papermaking fibers on the backside 34 of the belt 10, reduces the differential pressure across the belt 10 as vacuum is applied thereto during the papermaking process, and increases the rise time of the differential pressure prior to the maximum differential pressure occurring.

A particularly preferred reinforcing structure 30 for use with the present invention may be made in accordance with the teachings of commonly assigned U.S. Pat. No. 5,098,522 issued Mar. 24, 1992 to Smurkoski, et al. which patent is incorporated herein by reference for the purposes of showing how to make a particularly preferred reinforcing structure 30 suitable for use with a papermaking belt 10 in accordance with the present invention and showing a process for making cellulosic fibrous structures using such a papermaking belt 10.

The other primary component of the papermaking belt 10 according to the present invention is the patterned framework of protuberances 20. The protuberances 20 define deflection conduits 40 therebetween. The deflection conduits 40 allow water to be removed from the cellulosic fibrous structure by the application of differential fluid pressure, by evaporative mechanisms, or both when drying air passes through the cellulosic fibrous structure while on the papermaking belt 10 or a vacuum is applied through the belt 10. The deflection conduits 40 allow the cellulosic fibrous structure to deflect in the Z-direction and generate the caliper of and aesthetic patterns on the resulting cellulosic fibrous structure.

The protuberances 20 are arranged in a semicontinuous pattern. As used herein, a pattern of protuberances 20 is considered to be "semicontinuous" if a plurality of the protuberances 20 extends substantially throughout one dimension of the apparatus, and each protuberance 20 in the plurality is spaced apart from adjacent protuberances 20.

Figure 3:
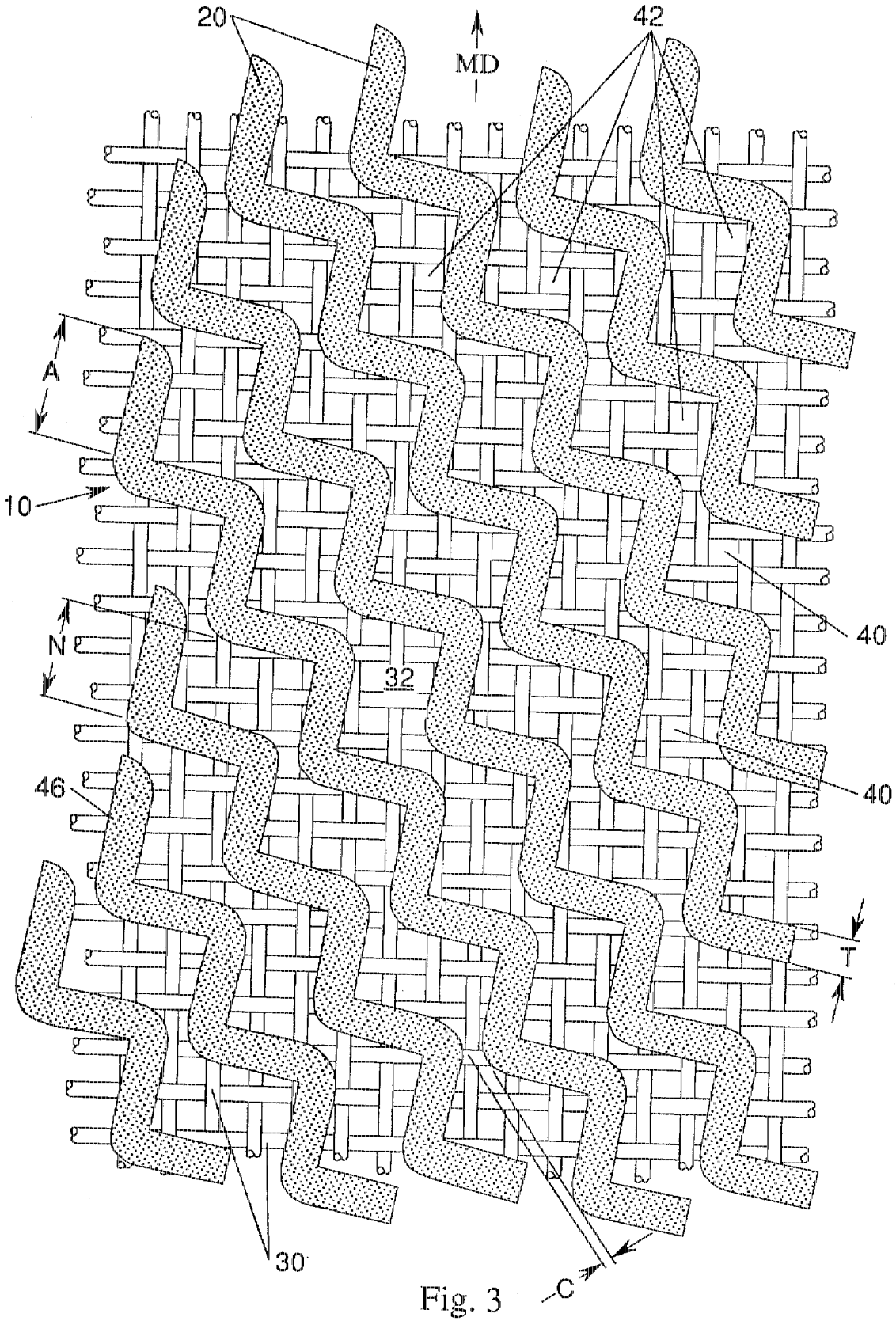
FIG. 3 is a top plan view of an alternative secondary belt according to the present invention having protuberances which are not equidistantly spaced from the adjacent protuberances and which form individual cells within the deflection conduits.

The protuberances 20 in the semicontinuous pattern may be generally parallel as illustrated in FIG. 1, may form a wave pattern as illustrated in FIG. 3, and/or may form a pattern in which adjacent protuberances 20 are offset from one another with respect to the phase of the pattern as illustrated in FIG. 3. The semicontinuous protuberances 20 may be aligned in any direction within the plane of the papermaking belt 10.

Thus, the protuberances 20 may span the entire cross machine direction of the belt 10, may endlessly encircle the belt 10 in the machine direction, or may run diagonally relative to the machine and cross machine directions. Of course, the directions of the protuberance 20 alignments (machine direction, cross machine direction, or diagonal) discussed above refer to the principal alignment of the protuberances 20. Within each alignment, the protuberance 20 may have segments aligned at other directions, but aggregate to yield the particular alignment of the entire protuberance 20.

Protuberances 20 arranged in a framework having a semicontinuous pattern are to be distinguished from a pattern of discrete protuberances 20, in which any one protuberance 20 does not extend substantially throughout a principal direction of the papermaking belt 10. An example of discrete protuberances 20 is found at FIG. 4 of commonly assigned U.S. Pat. No. 4,514,345 issued Apr. 30, 1985 to Johnson, et al.

Figure 2:
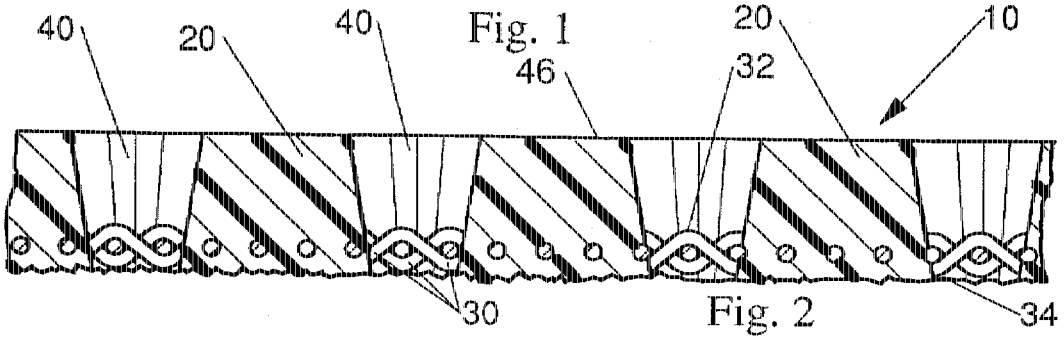
FIG. 2 is a vertical sectional view taken along lines 2—2 of FIG. 1.

Similarly, a pattern of semicontinuous protuberances 20 is to be distinguished from protuberances 20 forming an essentially continuous pattern. An essentially continuous pattern extends substantially throughout both the machine direction and cross machine direction of the papermaking belt 10, although not necessarily in a straight line fashion. Alternatively, a pattern may be continuous because the framework forms at least one essentially unbroken net-like pattern. Examples of protuberances 20 forming an essentially continuous pattern is illustrated by FIGS. 2–3 of the aforementioned U.S. Pat. No. 4,514,345 issued to Johnson, et al or by the aforementioned U.S. Pat. No. 4,528,239 issued to Trokhan.

As illustrated in FIG. 2, the framework of semicontinuous protuberances 20 according to the present invention is joined to the reinforcing structure 30 and extends outwardly from the paper contacting side 32 thereof in the Z-direction. The protuberances 20 may have straight sidewalls, tapered sidewalls, and be made of any material suitable to with suitable to withstand the temperatures, pressures, and deformations which occur during the papermaking process. Particularly preferred protuberances 20 are made of photosensitive resins.

The photosensitive resin, or other material used to form the pattern of semicontinuous protuberances 20, may be applied and joined to the reinforcing structure 30 in any suitable manner. A particularly preferred manner of attachment and joining is applying liquid photosensitive resin to surround and envelop the reinforcing structure 30, cure the portions of the liquid photosensitive resin which are to form the semicontinuous pattern of the protuberances 20, and wash away the balance of the resin in an uncured state. Suitable processes for manufacturing a papermaking belt 10 in accordance with the present invention are disclosed in the aforementioned U.S. Pat. No. 4,514,345issued to Johnson, et al., commonly assigned U.S. Pat. No. 4,528,239 issued Jul. 9, 1985 to Trokhan, and the aforementioned U.S. Pat. No. 5,098,522 issued to Smurkoski, et al., each of which patents is incorporated herein by reference for the purpose of showing a particularly preferred manner of forming the protuberances 20 and joining the protuberances 20 to the reinforcing structure 30.

As is evident from a reading of any of the three aforementioned patents incorporated by reference, the pattern of the protuberances 20 is determined by transparencies in a mask through which an activating wave length of light is passed. The activating light cures portions of the photosensitive resin opposite the transparencies. Conversely, the portions of the photosensitive resin opposite the opaque regions of the mask are washed away, leaving the paper contacting side 32 of the reinforcing surface exposed in such areas.

Thus, to form a particularly preferred embodiment of a papermaking belt 10 according to the present invention, the mask must be formulated with transparent regions having a semicontinuous pattern as described above. Such a mask will form a like pattern of protuberances 20 on the papermaking belt 10.

For the embodiments described herein, protuberances 20 forming a semicontinuous pattern should have characteristics which produce desired properties of the cellulosic fibrous structures. The geometry of the protuberances 20 significantly influences the properties of the resulting cellulosic fibrous structure made on the secondary belt 10. For example, the protuberances 20 may produce hinge lines in the cellulosic fibrous structure, which hinge lines impart softness or burst strength thereto.

Furthermore, the semicontinuous pattern of protuberances 20 will yield a like semicontinuous pattern of high and low density regions in the cellulosic fibrous structure made on this belt 10. Such a pattern in the resulting cellulosic fibrous structure occurs for two reasons. First, the regions of the cellulosic fibrous structure coincident the semicontinuous deflection conduits 40 will be dedensified by the air flow therethrough or will be dedensified by the application of a vacuum to the deflection conduits 40. Preferably, the regions of the cellulosic fibrous structure coincident the protuberances 20 will be densified by the transfer of the cellulosic fibrous structure to a rigid backing surface, such as a Yankee drying drum.

The geometry of the protuberances 20 may be considered in a single direction, or may be considered in two dimensions, and may be considered as either lying within or normal to the plane of the secondary belt 10 according to the present invention.

Particularly, the Z-direction extent of the protuberances 20 in a single direction normal to the plane of the belt 10 determines the height of the protuberances 20 above the paper contacting surface of the reinforcing structure 30. If the height of the protuberances 20 is too great, pinholing and apparent transparencies or light transmission through the cellulosic fibrous structure will occur. Conversely, if the Z-direction dimension of the protuberances 20 is smaller, the resulting cellulosic fibrous structure will have less caliper. As noted above, both pinholing and low caliper are undesirable because they present an apparently lower quality cellulosic fibrous structure to the consumer.

For the embodiments described herein, the protuberances 20 preferably have a height between 0.05 and 0.64 millimeters (0.002 and 0.025 inches), preferably between 0.13 and 0.38 millimeters (0.005 and 0.015 inches), and more preferably between 0.20 and 0.26 millimeters (0.008 and 0.010 inches).

Referring back to FIG. 1 and continuing the single direction analysis, the spacing between inwardly facing edges of adjacent protuberances 20 must be considered. If, within limits, the spacing is too great for a given Z-direction extent, pinholing is more likely to occur. Also, if the spacing between the inwardly facing edges of adjacent protuberances 20 is too great, another undesired resultant phenomenon may be that fibers will not span the distal ends 46 of adjacent protuberances 20, resulting in a cellulosic fibrous structure having lesser strength than can be obtained if individual fibers span adjacent protuberances 20. Conversely, if the spacing between the inwardly facing edges of adjacent protuberances 20 is too small, the cellulosic fibers will bridge adjacent protuberances 20, and in an extreme case little caliper generation will result. Therefore, the spacing between the inwardly facing surfaces of adjacent protuberances 20 must be optimized to allow sufficient caliper generation to occur and minimize pinholing.

For the embodiments described herein, the inwardly facing surfaces of adjacent protuberances 20 may be spaced about 0.64 to about 1.40 millimeters apart (0.025 to 0.055 inches) in a direction generally orthogonal to such surfaces. This spacing will result in a cellulosic fibrous structure which generates maximum caliper when made of conventional cellulosic fibers, such as Northern softwood kraft or eucalyptus.

A further single dimension analysis relates to the width across the distal edge of the protuberance 20. The width is measured generally normal to the principal dimension of the protuberance 20 within the plane of the belt 10 at a given location. If the protuberance 20 is not wide enough, the protuberance 20 will not withstand the pressures and temperature differentials encountered during and incidental to the papermaking process. Accordingly, such a papermaking belt 10 will have a relatively short life and have to be frequently replaced. If the protuberances 20 are too wide, a more one-sided texture will again result and the cell size, discussed below, must be increased to compensate.

Of course, it is to be recognized that the protuberances 20 are typically tapered and may occupy a greater projected surface area at the proximal edge of the protuberance 20. For the embodiments described herein, typically the proximal area of the protuberances 20 is about 25 to 75 percent of the belt 10 surface area and the distal area of the protuberances 20 is about 15 to 65 percent of the belt 10 surface area.

Generally, for the embodiments described herein, protuberances 20 having a width at the proximal ends of about 0.3 to 1.3 millimeters (0.011 to 0.050 inches) are suitable. The protuberances 20 may have a width at the distal ends 46 of about 0.13 to 0.64 millimeters (0.005 to 0.025 inches), and preferably may have a width at the distal ends 46 of about 0.20 to 0.46 millimeters (0.008 to 0.018 inches).

Examining the pattern of seat continuous protuberances 20 in two dimensions, particularly the machine and cross machine directions, it is apparent that two different types of protuberances 20 may be utilized in accordance with the present invention. All of the protuberances 20 are generally nonintersecting. The first type of protuberance 20, illustrated in FIG. 1, utilizes generally parallel (although not necessarily straight) protuberances 20. These protuberances 20 have generally equal spacings in the deflection conduits 40 therebetween, so that individual cells 42 are not formed.

Conversely, as illustrated in FIG. 3, the secondary belt 30 may have noncontacting protuberances go which are not equidistantly spaced from the adjacent protuberances 20 and which may define individual cells 42 within the deflection conduits 40. The protuberances 20 of such a belt 10 may not be parallel. Furthermore, the protuberances 20 may not be of constant width. Either arrangement may yield deflection conduits 40 having fiber bridging of adjacent protuberances 20 in certain areas and fiber deflection into the deflection conduits 40 in other areas.

This arrangement provides the advantage that a cellulosic fibrous structure having a semicontinuous pattern and three mutually different densities may be formed. The three densities occur due to: 1) low density fibers spanning adjacent protuberances 20 and which deflect in the Z-direction from the distal end 46 of the protuberances 20 an amount at least about the thickness of the high density regions of the cellulosic fibrous structure; 2) intermediate density fibers which bridge adjacent protuberances 20 and deflect in the Z-direction an amount less than about 50 percent of the Z-direction deflection found in the density fibers of the cellulosic fibrous structure; and 3) high density densified fibers coincident the distal ends 46 of the protuberances A semicontinuous pattern three density cellulosic fibrous structure such as this provides the benefits of more isotropic flexibility, better softness, and a more pleasing texture than a like cellulosic fibrous structure made on a secondary belt 10 having parallel protuberances The three densities may be arranged in cells 42 of low density regions bounded by regions of intermediate and high density.

Cells 42 are defined as the discrete low density regions in the cellulosic fibrous structures that occur between and are bounded by the semicontinuous high density regions and the discrete intermediate density regions in a cellulosic fibrous structure containing at least three different densities, or are defined as the corresponding regions of the secondary belt 10 producing such a cellulosic fibrous structure.

If the individual cells 42 in deflection conduits 40 between the protuberances 20 are too large, the caliper generated during the drying process may not withstand subsequent calendering or other converting operations, particularly for relatively low basis weight cellulosic fibrous structures. Thus, a relatively lower caliper (and apparently lower quality) product will be presented to the consumer-despite adequate caliper generation occurring during manufacture. Also, large cells may increase the one-sidedness of the texture.

Conversely, if the individual cells 42 in the deflection conduits 40 between adjacent protuberances 20 are too small, low caliper generation may result, as noted above relative to the one-dimensional spacing between adjacent protuberances 20. Furthermore, if the individual cells 42 are too small, the width of the distal edges of the cells may be too small for a given cell size and poor belt 10 life will again result.

The individual cells 42 may be arranged in any desired matrix. The individual cells 42 may be aligned in either or both the machine direction and/or cross machine direction. The individual cells 42 may be staggered in either the machine direction, the cross machine direction, or, alternatively, preferably the individual cells 42 are bilaterally staggered. For the embodiments described herein, protuberances 20 having approximately 16 to 109 cells 42 per square centimeter (100 to 700 cells 42 per square inch), and preferably approximately 31 to approximately 78 individual cells 42 per square centimeter (200 to 500 individual cells 42 per square inch) and more preferably about 62 cells per square centimeter (400 cells per square inch) are judged suitable.

In an alternative embodiment of the invention, the belt 10 having a semicontinuous pattern of protuberances 20 and semicontinuous pattern of deflection conduits 40 may be used as a forming wire in the wet end of the papermaking machine. When such a belt 10 is used as a forming wire in the papermaking machine, a cellulosic fibrous structure having regions of at least two mutually different basis weights will result. The at least two mutually different basis weights in the cellulosic fibrous structure may be aligned in either the machine direction, the cross machine direction, or diagonally thereto.

This cellulosic fibrous structure provides the advantage, for example, that if the semicontinuous pattern of mutually different basis weights is aligned in the cross machine direction and the cellulosic fibrous structure is to be utilized as a core-wound paper product (such as toilet tissue or paper toweling) the low basis weight regions provide a tear line. This tear line is useful when the free end of the core-wound paper product is pulled in tension, such as occurs when the user desires a finite length of product for household tasks. The cellulosic fibrous structure will usually tear at the line formed through the low basis weight region. This arrangement provides the advantage that the perforating operation may be eliminated during paper converting and the further advantage that the consumer my select sheets of almost any different size, as may be needed for the task, rather than being limited by the spacing between the perforations provided by the converting operation.

EXAMPLES

Comparative examples of cellulosic fibrous structures were made on a secondary belt 10 having a continuous pattern according to the aforementioned Trokhan patent, a secondary belt 10 having a discrete pattern according to FIG. 8 of commonly assigned U.S. Pat. No. 4,239,065 issued Dec. 16, 1980 to Trokhan, and a secondary belt 10 having a semicontinuous pattern according to the present invention were constructed.

The semicontinuous pattern belt 10 had a large sized pattern of roses superimposed on the semicontinuous protuberance 20, as illustrated in commonly assigned application Ser. No. 07/718,452 filed Jun. 19, 1991 in the names of Rasch et al. The protuberances 20 were 0.33 millimeters (0.013 inches) in thickness, as designated in FIG. 3 by dimension T. The protuberances 20 formed generally rectangularly shaped cells 42 having a major dimension of 1.22 millimeters (0.048 inches), as designated by dimension A and a minor dimension of 0.69 millimeters (0.027 inches), as designated by dimension N. Each protuberance 20 was most closely separated from the adjacent protuberance 20 by a distance of 0.23 millimeters (0.009 inches), as indicated by dimension C.

The continuous pattern belt and semicontinuous pattern belt 10 each had 62 cells 42 per square centimeter (400 cells 42 per square inch). The discrete pattern belt had a mesh count of 23×17 filaments per square centimeter (59×44 filaments per square inch), yielding approximately 67 cells per square centimeter (433 cells per square inch). A cell was determined to be either a individual polygonal deflection conduit in the continuous pattern belt made according to the aforementioned Trokhan patent, a unit formed by six filament knuckles in the discrete pattern belt made according to the aforementioned Trokhan '065 patent, or a unit cell 42 within a deflection conduit 40 as previously defined in the belt 10 according to the present invention.

The continuous pattern and semicontinuous pattern secondary belts 10 each had a Z-direction protuberance 20 extent of about 0.23 millimeters (0.009 inches). The apparent protuberance 20 height for the belt 10 made according to the aforementioned Trokhan '065 patent was measured by the pattern of the weave. Particularly, the apparent protuberance 20 height was taken as the caliper of the secondary belt, less the shute filament diameter. To maintain approximately equal cell 42 counts and an appropriate diameter of the filaments forming the reinforcing structure 30 in the discrete pattern belt 30, the aforementioned 0.23 millimeters (0.009 inches) protuberance 20 height could not be maintained for the discrete pattern belt 10. Instead the apparent protuberance 20 height was 0.32 millimeters (0.013 inches).

This example illustrates the choice that must be made between cell size and protuberance 20 height when using a discrete pattern belt 10 made according to the aforementioned Trokhan '065 patent. However, given the great commercial success of cellulosic fibrous structures made on belts 10 according to the aforementioned Trokhan '065 patent, it was judged to be a suitable standard against which to compare cellulosic fibrous structures made on a semicontinuous pattern belt 10 according to the present invention.

The cellulosic fibrous structure made on these three aforementioned belts 10 were layered in a trilaminate. The two outboard layers each comprised at least forty percent of the total furnish and were eucalyptus fiber. The central layer comprised the balance of the furnish and was Northern softwood kraft (NSK) fiber. The layering process is described in more detail in commonly assigned U.S. Pat. No. 3,994,771 issued Nov. 30, 1976, to Norgan, Jr., et al., which patent is incorporated herein by reference for the purpose of showing how these layered cellulosic fibrous structures were made for this example.

The cellulosic fibrous structures made for these examples had a consistency of 20 percent at the couch roll. The vacuum shoe used to transfer the embryonic web from the forming wire to the secondary belts had a vacuum of 31.8 centimeters of Mercury (12.5 inches of Mercury).

The resulting cellulosic fibrous structures were tested for basis weight as measured according to ASTM Standard D585-74, tensile strength as measured on a Thawing Albert tensile machine having a cross head separation rate of 10.2 centimeters per minute (4 inches per minute), and a gage length of 5.08 centimeters (2 inches). Caliper was measured under a confining pressure of 14.7 grams per square centimeter (95 grams per square inch). The tensile strength varied little from sample to sample, when the effect of different percentages of Northern softwood kraft fibers is taken into account.

As can be seen from Table I, the basis weights of all three samples were essentially constant. The cellulosic fibrous structure made on the discrete pattern belt 10 had considerably less caliper than the cellulosic fibrous structures made on the semicontinuous and continuous patterned belts 10.

The cellulosic fibrous structure made on the continuous pattern belt 10 showed no correlation of doctor blade impact angle to caliper. The cellulosic fibrous structures made on the semicontinuous and discrete belts 10 showed a monotonically decreasing relationship in caliper as the impact angle of the doctor blade was increased. Thus, the only belt 10 to provide beth relatively high caliper and a linear and monotonic correlation of doctor blade impact angle to such caliper to the belt 10 according to the present invention.

The caliper benefits shown in Table I were maintained throughout subsequent converting operations.

TABLE I

| Condition | Continuous Pattern Through-Air Drying Belt | | | Discrete Pattern Through-Air Drying Belt | | | Semicontinous Pattern Through-Air Drying Belt | | |
|---|---|---|---|---|---|---|---|---|---|
| Doctor Blade Angle (degrees) | 78 | 83 | 90 | 70 | 81 | 89 | 70 | 81 | 90 |
| Basis Weight (pounds per 3,000 square feet) | 18.2 | 18.3 | 18.1 | 18.1 | 18.4 | 18.2 | 18.1 | 18.3 | 18.3 |
| NSK (percent) | 20 | 20 | 20 | 20 | 10 | 10 | 10 | 10 | 5 |
| Total Tensile (g/in.) | 398 | 436 | 423 | 460 | 455 | 423 | 416 | 452 | 457 |
| Caliper (mils) | 17.7 | 17.5 | 17.5 | 13.9 | 12.8 | 12.3 | 19.2 | 18.4 | 18.0 |

Additional testing was conducted to determine the effects of protuberance 2O pattern on sheet curl, shrinkage, and pinholing. For these tests the doctor blade impact angle was held at a constant impact angle of 81 degrees. A discrete pattern belt 10 made generally according to FIG. 4 of the aforementioned Johnson, et al. patent was substituted for the discrete pattern belt 10 made according to the Trokhan '065 patent utilized in the prior Examples. The discrete pattern belt 10 utilized for this example had 62 cells per square centimeter (400 cells per square inch) and a protuberance 20 height of 0.2 millimeters (0.009 inches). The protuberances 20 were generally rectangularly shaped with rounded ends, had an aspect ratio of 3.375 and alternating protuberances 20 were oriented at 90 degree angles, as illustrated by the imprint pattern of FIG. 1 of the aforementioned Trokhan '065 patent.

The cellulosic fibrous structures made on these three belts 10 had approximately equal basis weights, to compare the effects of protuberance 20 pattern on sheet curling, shrinkage and pinholing. Pinholing was measured by a Paperlab-1 Formation RoboTester supplied by Kajaani Automation of Norcross, Ga.

Sheet curl and sheet shrinkage were ascertained by measuring the sheet width just prior to the Yankee (PY), between the calender rolls and the reel (BCR), and after cutting from the parent roll (AC). Sheet curl is then given by the formula: (PY−BCR)/PY. Sheet shrinkage is given by the formula: (PY−AC)/PY.

Table IIA illustrates three cellulosic fibrous structures made according to the aforementioned belts 10 and having a total tensile strength of approximately 400 grams per inch. Table IIB illustrates the same cellulosic fibrous structures, except the total tensile strength is about 500 grams per inch. In both Table IIA and Table IIB, softness (which is strongly influenced by tensile strength) is corrected to the appropriate tensile strength by 0.1 0PSU of softness per 25 grams per inch of tensile strength.

TABLE IIA

| Condition | Continuous Pattern Through-Air Drying Belt | Discrete Pattern Through-Air Drying Belt | Semicontinuous Pattern Through-Air Drying Belt |
|---|---|---|---|
| Starch (pounds/ton) | 4 | 4 | 4 |
| NSK (percent) | 10 | 10 | 10 |
| Basis Weight (pounds per 3000 square feet) | 18.23 | 18.05 | 18.21 |
| Uncalendered Caliper (mils) | 19.2 | 18.7 | 16.0 |
| Softness (PSU) | 0.73 | 0.51 | 0.48 |
| Tens. Cor. Soft. - 400 (PSU) | 0.58 | 0.47 | 0.37 |
| CD Tensile (g/in.) | 162 | 181 | 179 |
| MD Tensile (g/in.) | 201 | 209 | 194 |
| Total Tensile (g/in.) | 363 | 390 | 373 |
| Burst/Tensile Ratio | 0.40 | 0.29 | 0.36 |
| CD Stretch (percent) | 12.94 | 6.16 | 7.50 |
| CD Modulus (percent) | 5.31 | 15.07 | 12.78 |
| MD Modulus (percent) | 2.85 | 3.00 | 3.45 |
| Modulus (percent) | 3.89 | 6.72 | 6.64 |
| Dry Burst (g) | 146.6 | 114.7 | 134.5 |
| Sink (sec.) | 3.29 | 1.58 | 2.13 |
| Pinholes (percent lightspots) | 3.39 | 1.91 | 2.42 |
| Sheet Curl (percent) | 5.9 | 0.0 | 0.0 |
| Sheet Shrink (percent) | 0.7 | 0.0 | 0.0 |

TABLE IIB

| Condition | Continuous Pattern Through-Air Drying Belt | Discrete Pattern Through-Air Drying Belt | Semicontinuous Pattern Through-Air Drying Belt |
|---|---|---|---|
| Softness (PSU) | 0.79 | −0.08 | 0.5 |
| Tens. Cor. Soft. - 400TT (PSU) | 0.85 | 0.23 | 0.72 |
| Tens. Cor. Soft. - 500TT (PSU) | 0.45 | −0.17 | 0.32 |
| Basis Weight (pounds per 3000 square feet | 18.09 | 18.18 | 17.89 |
| CD Tensile (g/in.) | 170 | 212 | 200 |
| MD Tensile (g/in.) | 246 | 265 | 255 |
| Total Tensile (g/in.) | 416 | 477 | 455 |
| Starch (pounds/ton) | 4 | 4 | 4 |
| NSK (percent) | 20 | 15 | 20 |
| CD Stretch (percent) | 13.56 | 6.26 | 7.12 |
| CD Modulus (percent) | 5.05 | 17.90 | 15.71 |
| MD Modulus (percent) | 3.80 | 3.60 | 4.09 |
| Modulus (percent) | 4.38 | 8.03 | 8.02 |
| Burst (g) | 181.4 | 148.4 | 162.9 |
| Sink (sec.) | 3.05 | 1.49 | 3.11 |
| Pinholes (percent lightspots) | 4.97 | 5.35 | 1.84 |
| Sheet Curl (percent) | 5.2 | 0.0 | 0.0 |
| Sheet Shrink (percent) | 0.0 | 0.0 | 0.0 |
| Burst/Tensile Ratio | 0.44 | 0.31 | 0.36 |

As can be seen from Tables IIA and IIB, the cellulosic fibrous structure made on the belt 10 according to the present invention had better sheet shrinkage and curl than the cellulosic fibrous structure made on the continuous pattern belt, but had shrinkage and curl generally equivalent to that of the cellulosic fibrous structure made on the discrete pattern belt. Also, the cellulosic fibrous structure made on the belt 10 according to the present invention had a better burst strength to tensile strength ratio than the cellulosic fibrous structure made on a discrete pattern belt, however the burst strength to tensile strength ratio was not as good as that of the cellulosic fibrous structure made on the continuous pattern belt. Furthermore, the cellulosic fibrous structure made on the belt 10 according to the present invention had better pinholing than the cellulosic fibrous structure made on the continuous pattern belt, but had mixed results relative to pinholing compared to the cellulosic fibrous structure made on the discrete pattern belt.

It is recognized that many variations and combinations of patterns, protuberance 20 sizes, and spacings say be made within the scope of the present invention. All such variations are within the scope of the following claims.

What is claimed is:

1. A macroscopically monoplanar cellulosic fibrous structure having two mutually orthogonal principle directions, a machine direction and a cross-machine direction, said cellulosic fibrous structure further having a first plurality of unembossed regions having a first density, and a second plurality of unembossed regions having a second density different from and less than said first density, wherein said first plurality of regions form a semicontinuous pattern of high density regions separated from each other by said second plurality of regions which form a semicontinuous pattern of low density regions, said low density regions comprising fibers molded generally perpendicular to said two mutually orthogonal principal directions, each of said high density regions and said low density regions having a vector component extending substantially throughout one of said principle directions of said cellulosic fibrous structure.

2. A cellulosic fibrous structure according to claim 1, wherein said cellulosic fibrous structure is through-air dried.

3. A cellulosic fibrous structure according to claim 2, wherein said cellulosic fibrous structure is creped.

4. A macroscopically monoplanar cellulosic fibrous structure having two mutually orthogonal principal directions, a machine direction and a cross-machine direction, said cellulosic fibrous structure further having three regions, a first plurality of semicontinuous regions having a first density, a second plurality of regions having a second density different from and less than said first density,and a third plurality of regions having a third density, said third density being greater than said second density and less than said first density, wherein said regions having said second density are bounded by said regions having said third density, said regions having said second density and said third density combining to form a semicontinuous pattern and wherein said first region has and said second and third regions combined have a vector component extending substantially throughout one of said principal directions of said cellulosic fibrous structure.

5. A cellulosic fibrous structure made according to claim 4, wherein said regions having said second density are also bounded by said regions having a first density.

* * * * *

UNITED STATES PATENT AND TRADEMARK OFFICE

CERTIFICATE OF CORRECTION

PATENT NO. : 5,714,041

DATED : February 3, 1998

INVENTOR(S) : Peter G. Ayers et al.

It is certified that error appears in the above-identified patent and that said Letters Patent is hereby corrected as shown below:

Column 1, line 11, "us" should read – used --.

Column 1, line 16, after "in" insert – a --.

Column 2, line 66, after "angle" the comma should be a period.

Column 4, line 15, after "sibility" delete "s" should read – is --.

Column 4, line 21, , after "Accordingly" insert – it --.

Column 5, line 19, after "in" insert – a --.

Column 5, line 20, after "in" insert– a --.

Column 7, line 34, delete "suitable to with".

Column 9, line 39, "seat continuous" should read – semicontinuous --.

Column 9, line 49, "30" should read – 10 --.

Column 9, line 50, "go" should read – 20 --.

Column 10, line 2, after "the" insert -- low --.

Column 10, line 4, after "protuberances" insert – 20. --.

Column 10, line 9, after "protuberances" insert – 20 --.

UNITED STATES PATENT AND TRADEMARK OFFICE
CERTIFICATE OF CORRECTION

PATENT NO. : 5,714,041

DATED : February 3, 1998

INVENTOR(S) : Peter G. Ayers et al.

It is certified that error appears in the above-identified patent and that said Letters Patent is hereby corrected as shown below:

Column 11, line 9, "my" should read – may --.

Column 12, line 2, "30" should read – 10 --.

Column 12, line 34, "Thawing" should read – Thwing --.

Column 12, line 55, "beth" should read – both --.

Column 12, line 57, "to" should read – is --.

Column 14, line 32, "OPSU" should read – PSU --.

Column 15, line 45, "say" should read – may --.

Column 15, line 50, "principle" should read – principal --.

Column 16, line 31, "principle" should read – principal --.

Signed and Sealed this

Sixth Day of October, 1998

*Attest:*

*Attesting Officer*

BRUCE LEHMAN

*Commissioner of Patents and Trademarks*